US008418700B2

(12) United States Patent
Guthans

(10) Patent No.: US 8,418,700 B2
(45) Date of Patent: Apr. 16, 2013

(54) HAIR STYLING ASSEMBLY

(76) Inventor: Debra E. Guthans, River Ridge, LA (US)

( * ) Notice: Subject to any disclaimer, the term of this patent is extended or adjusted under 35 U.S.C. 154(b) by 250 days.

(21) Appl. No.: 12/590,791

(22) Filed: Nov. 13, 2009

(65) Prior Publication Data

US 2011/0114110 A1 May 19, 2011

(51) Int. Cl.
*A45D 6/02* (2006.01)

(52) U.S. Cl.
USPC ..... 132/237

(58) Field of Classification Search ..... 132/237, 132/226, 261, 262, 313; 15/145, 176.6, 176.1; 215/356, 330
See application file for complete search history.

(56) References Cited

U.S. PATENT DOCUMENTS

| | | | | |
|---|---|---|---|---|
| 2,463,390 | A * | 3/1949 | Bank et al. | 132/265 |
| 3,204,277 | A | 9/1965 | Visman et al. | |
| 3,257,541 | A | 6/1966 | Jorgensen | |
| 3,967,630 | A | 7/1976 | Zuhlsdorff et al. | |
| 4,292,986 | A | 10/1981 | Ergaver et al. | |
| 4,375,858 | A * | 3/1983 | Shah et al. | 215/217 |
| 4,473,086 | A * | 9/1984 | Thaler et al. | 132/229 |
| 4,642,837 | A | 2/1987 | Nichols et al. | |
| 4,811,445 | A | 3/1989 | Lagieski et al. | |
| 5,479,951 | A | 1/1996 | Denebeim | |
| 5,887,600 | A | 3/1999 | Wilk | |
| 5,992,423 | A | 11/1999 | Tevolini | |
| 6,024,101 | A | 2/2000 | Garner | |
| 6,029,307 | A | 2/2000 | Baudoin | |
| 6,070,597 | A | 6/2000 | Motherhead | |
| 6,230,716 | B1 | 5/2001 | Minoletti | |
| 6,502,585 | B1 | 1/2003 | Mazzei et al. | |
| 6,739,016 | B2 | 5/2004 | Bigio | |
| 6,789,549 | B2 | 9/2004 | Johnson | |
| 7,162,802 | B2 | 1/2007 | Benardeau et al. | |
| 7,296,580 | B1 * | 11/2007 | Sbardella | 132/122 |
| 2005/0139226 | A1 * | 6/2005 | Kampel | 132/262 |
| 2005/0230341 | A1 * | 10/2005 | Dong | 215/228 |
| 2007/0029302 | A1 | 2/2007 | Russo | |
| 2008/0105274 | A1 * | 5/2008 | Kennedy | 132/210 |
| 2008/0244851 | A1 | 10/2008 | Sutherland | |
| 2008/0283083 | A1 | 11/2008 | Piao | |
| 2009/0070951 | A1 * | 3/2009 | Sever | 15/143.1 |
| 2010/0236571 | A1 * | 9/2010 | Haziza | 132/210 |

FOREIGN PATENT DOCUMENTS

DE 4437703 A1 4/1996

* cited by examiner

*Primary Examiner* — Todd Manahan
*Assistant Examiner* — Brianne Kalach
(74) *Attorney, Agent, or Firm* — Keaty Law Firm, LLC

(57) ABSTRACT

A hair styling tool kit has cylindrical hair roller(s) having bristles positioned on exterior thereof, a proximate end, a distant end and an opening formed in the proximate end. A handle is configured to detachably engage the proximate end of the hair roller(s), one at a time, and facilitate rolling of hair on the hair roller(s). The body of the hair roller(s) is manufactured from heat absorbing material that helps in transmitting heat to the hair rolled on the hair roller(s).

8 Claims, 3 Drawing Sheets

HAIR STYLING ASSEMBLY

BACKGROUND OF THE INVENTION

This invention relates to hair styling tools, and more particularly to hair rollers that can be heated during a hair styling process.

In the field of hair styling, it is conventional to roll hair about a plurality of cylindrically-shaped rollers while the hair is damp and then dry the hair while it is still in its rolled state. The object of the process is to obtain a hair style having a fuller appearance and enhanced body.

Currently, there are two principal methods for rolling and drying hair. The first involves the use of a hairbrush with a hair dryer to brush the hair strands, while lifting the hair and rolling it over the brush head. Another method involves rolling strands of hair on a plurality of cylindrical rollers and allowing the hair to dry either under a hair dryer or while using a blow dryer.

However, each of these methods has its drawbacks, one of the principal being difficulty in coordinating rolling and blow drying, particularly when not done by a hairdresser. Often times, the result of home styling is less than satisfactory particularly in the back of the head, when a person has to use an additional mirror. A person has to hold a brush in one hand, a blow dryer—in another and also manipulate the mirror for better view of the back of the head.

As to the hair rollers, it is well known that most conventional hair rollers are formed from plastic with no hair bristles, which makes it difficult in achieving "natural" curls and waves. Conventional clips, when left on the hair roller for long periods of time during drying of the hair tend to leave a wave line where the clip compresses the hair. As a result, the task of properly styling hair becomes frustrating and time-consuming.

The present invention contemplates elimination of drawbacks associated with the prior art and provision of a hair roller and hairbrush assembly that can be used by a person while styling hair at home to achieve professional results.

SUMMARY OF THE INVENTION

It is, therefore, an object of the present invention to provide a hair styling tool that can be used to roll and brush hair in one application.

It is another object of the invention to provide a hair styling assembly that uses a detachable handle with bristled hair rollers.

It is a further object of the invention to provide a styling tool that can be used by professional hair dressers and non-professional users for styling the hair.

These and other objects of the invention are achieved through a provision of a hair styling assembly that comprises a cylindrical hair roller having bristles positioned on exterior thereof. The body of the hair roller is formed from a heat-absorbing material and has a plurality of openings for better air circulation. One end of the hair roller has an engagement member for detachably engaging with a handle. The engagement can be by threads, or a locking tab activated by a compression spring mounted in the handle, or by a locking wedge releasable through compression of a circumferential flange mounted on an engaging end of the handle.

The assembly can be sold as a kit that has a plurality different size rollers and one or more handles, clips for securing hair rolled on the hair rollers and an instruction sheet. The process of styling hair has the steps of first engaging the handle with one hair roller, rolling a strand of hair on the roller, securing the hair by a clip, disengaging the handle, and then engaging the handle with the next roller. The process of securing the handle to a hair roller, rolling the hair and clipping continues until the user secures the desired number of hair rollers on the head.

The user then dries the hair using a hair dryer, leaves the hair on the rollers to cool and then removes the hair rollers. The hair is then styled in a desired fashion.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
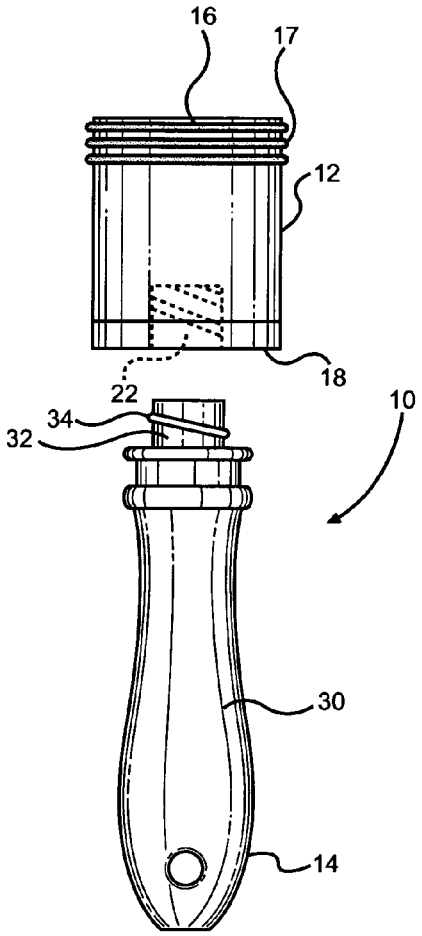
FIG. 1 is perspective view of the hair roller and handle assembly according to the first embodiment of the present invention.

Turning now to the drawings in more detail, numeral 10 designates the hair styling assembly according to the first embodiment of the invention. The assembly 10 comprises a plurality of cylindrical hair rollers 12 and a handle 14 detachably securable to one hair roller 12 at a time. All hair rollers have similar construction and therefore reference will be made to a single hair roller 12 illustrated in FIGS. 1, 6, 7 and 8.

The exterior of the roller 12 carries a plurality of bristles 17. Even though only three rows of bristles are shown in FIG. 1, it will be understood that the entire exterior surface of the roller 12 is covered with bristles 17. The bristles 17 are designed to provide fuller and higher appearance to the styled hairdo.

In one aspect, the body of the roller 12 is formed from a heat-conductive material, for instance ceramic having a predetermined thermal conductivity. As will be described below, the heat capacity of the ceramic material, the ability to absorb heat from a blow dryer plays a role in the operation of the instant hair styling tool. The roller body may be provided with a plurality of openings 15 to facilitate air circulation through the roller 12.

The roller 12 has a first distant end 16 and a second proximate end 18. The distant end 16 may be open, while the proximate end 18 has a circular plate 20 partially covering the central opening. The plate 20 may be provided with a plurality of spaced openings 21 to facilitate air circulation through the roller 20. An insert 22 is fitted in an opening 24 formed in the plate 20; the insert 22 is provided with internal threads.

The handle 14 has a gripping portion 30 and a proximate portion 32 having external threads 34 that match the internal threads of the insert 22. The proximate end 32 of the handle 30 is configured to threadably engage the insert 22 of the hair roller 12.

Figure 8:
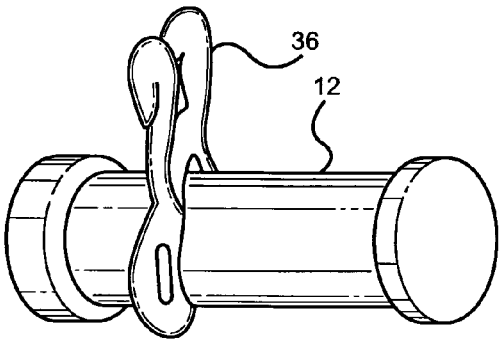
FIG. 8 is a perspective view illustrating a hair roller of the instant invention secured with a clip.

In one aspect, the instant invention provides for a kit consisting of a plurality of rollers 12 having different lengths and diameters to accommodate different hair length and style variations. The kit also comprises one or more handles 14 and a plurality of clips 36 (one such clip is shown in FIG. 8), which can be of conventional design, configured to hold the hair rolled onto the roller 12 in place.

In operation, a user selects a hair roller 12 from a plurality of hair rollers having different length and diameter depending on the desired finished style. The user then engages the selected hair roller with the handle 14 by threadably connecting the handle 14 with the insert 22. The user then separates a strand of damp hair and lifts the strand of hair using the roller/brush assembly 10, while the handle 14 is engaged with the roller 12. The user then rolls the strand of hair on the hair roller 12, separating the strand of hair into small segments by the bristles 17. Then, the user clips the strand of hair rolled on the roller 12 using one of the provided clips 36.

User then rotates the handle 14 to disengage the handle 14 from the roller 12 and engages the handle 14 with another roller 12 from the plurality of hair rollers provided in the kit. The user continues the steps of rolling and clipping the hair in the desired section of the head, or over the entire head. Once all desired strands of hair have been rolled on the rollers 12 and secured with the clips 36, the user uses a hair dryer, which can be a hand-held hair dryer for drying the hair. The heat-conductive rollers 12 absorb the heat and transmit the heat to the hair, drying the hair while it is still rolled on the rollers 12.

In one aspect, the instructions provided in the kit would suggest that the user leave the rollers in the hair until the rollers are cool, which can take 5-10 minutes. The user then removes the rollers and brushes the hair into a desired style.

Figure 2:
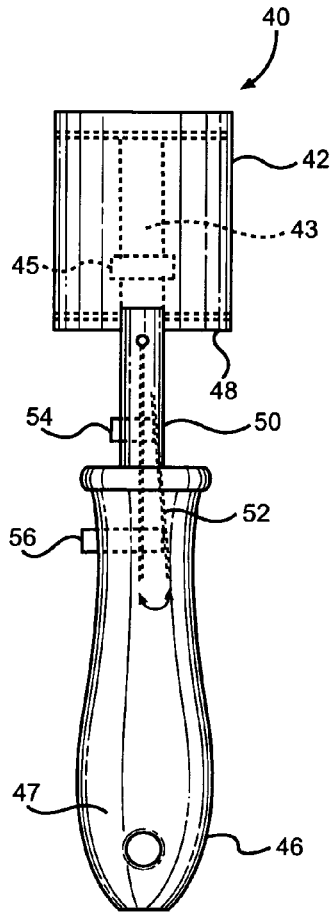
FIG. 2 is perspective view of the hair roller and handle assembly according to the second embodiment of the present invention.

Turning now to FIG. 2, the second embodiment of the hair styling assembly is shown designated by numeral 40. As can be seen in the drawing, the assembly 40 comprises a hair roller 42 and a handle 46. Although not shown, it will be understood that the kit contains a plurality of rollers 40, while reference will be made to a single roller 40. The roller 42 is also provided with a plurality of bristles on its exterior surface and a plurality of openings for air circulation. In this embodiment, the roller 42 is provided with a central opening 43 which extends through a larger part of the roller 42. A transverse groove 45 is formed adjacent a proximate end 48 of the roller 42.

The handle 46 has a gripping portion 47 and a securing rod 50, which is affixed to the gripping portion 47. Fitted within the rod 50 and extending into the interior of the gripping portion 47 is a compression spring member 52, which can be configured as a leaf spring. A locking tab 54 is mounted on the rod 50; the locking tab 54 extends transversely to the longitudinal axis of the rod 50. As shown in the drawing, the locking tab 54 extends outwardly from the rod 50 when the handle 46 is not engaged with the roller 42. The compression spring 52 normally urges the locking tab 54 outwardly from the rod 50. The locking tab 54 is configured to fit into the transverse groove 45 when the handle 46 is engaged with the roller 42.

A lock/release button 56 is secured to the gripping portion 47 and extends outwardly therefrom, transversely to its longitudinal axis. The lock/release button 56 abuts the leaf spring 52, such that pushing on the button 56 causes compression of the spring 52 and release of the locking tab 54 from its engagement with the transverse groove 45. When the button 56 is depressed the leaf spring 52 moves away and allows the locking tab 54 to move into its groove in the rod 50.

In operation, the user engages the handle 46 with the roller 42 by pushing the rod 50 into the central opening 43 until the locking tab 54 locks in the groove 45. The user then rolls the damp strand of hair on the roller 42, clips the hair with a clip and pushes on the button 56 to release the locking tab 54. The user then uses the same handle 46 to engage another hair roller and continues with the process until the desired quantity of rollers are secured on the user's head.

The user then proceeds with applying heat to the hair, with the thermal roller 42 absorbing the heat and drying the hair in a manner described above. Once the hair is dry and the rollers are cooled, the user removes the rollers and styles the hair as desired.

Figure 3:
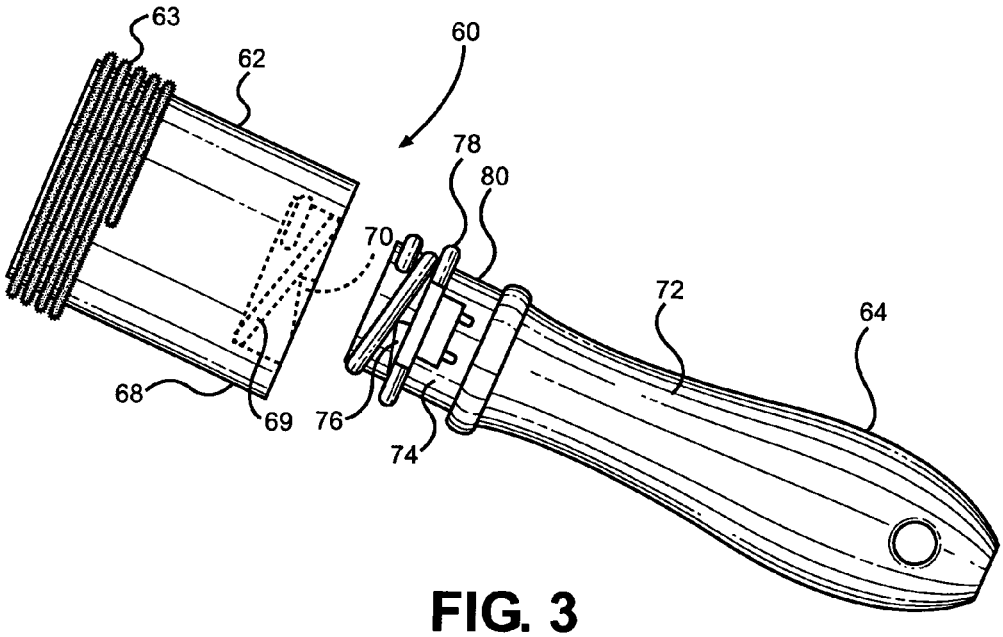
FIG. 3 is perspective view of the hair roller and handle assembly according to the third embodiment of the present invention.

FIG. 3 illustrates the third embodiment of the hair styling assembly, wherein the assembly is generally designated by numeral 60. The assembly 60 comprises a plurality of rollers 62 (only one of such rollers shown in FIG. 3) and a handle 64 that is designed to detachably engage any one of such rollers 62. The roller 62 is provided with bristles 63, some of which are shown in FIG. 3, as well as air openings similar to the openings 15. A proximate end 68 of the roller 62 is provided with internal threads 69, which can be made in the body of the roller 62 or in an insert fitted into the proximate end 68. A locking annular groove 70 is formed in the proximate end 68 adjacent the threads 69.

The handle 64 comprises a gripping portion 72 and an engaging portion 74. The engaging portion 74 is provided with external threads 75, which are configured to match the internal threads 69. A wedge-shaped locking tab 76 is secured on a circumferential flange 78, which is affixed to the engaging portion 74 adjacent the external threads 75. A locking member 80 is attached to an opposite surface of the flange 78.

Figure 4:
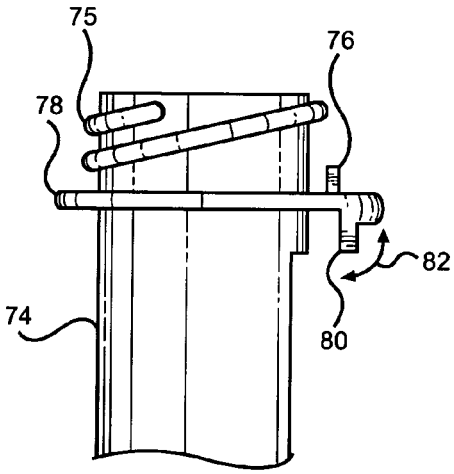
FIG. 4 is a detail view illustrating the locking mechanism used in the assembly of the third embodiment.
Figure 5:
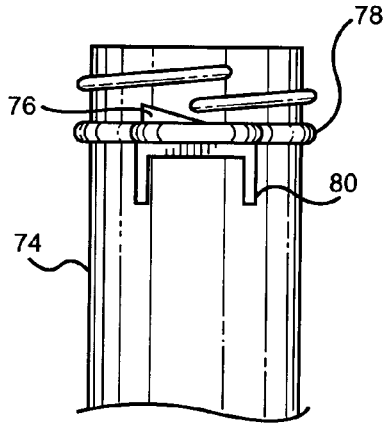
FIG. 5 is a detail view illustrating a front view of the locking mechanism used in the assembly of the third embodiment.
Figure 6:
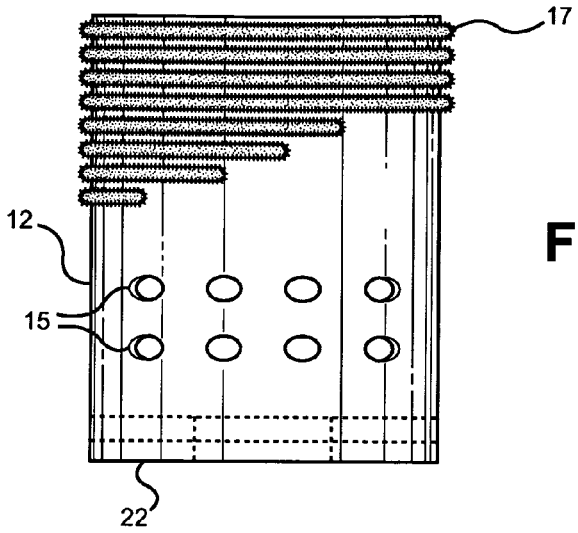
FIG. 6 is a detail view illustrating the hair roller of the present invention.
Figure 7:
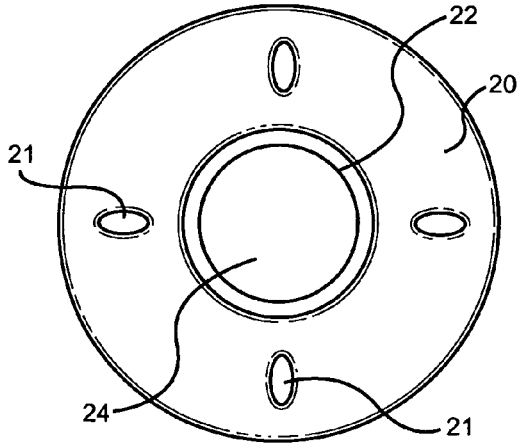
FIG. 7 is an end view showing the threaded end of the hair roller of the present invention.

The flange 78 is formed from a flexible resilient material that bends when pressed in a direction opposite the location of the locking tab 76. Once released, the flange returns to its original position. The movement of the flange 78 is illustrated by arrow 82 in FIG. 4. The rollers 62 are formed from a material similar to the material of rollers 12 and 42.

In operation, the user insert the engaging portion 74 into the opening formed in the proximate end 68 of the roller 62 and rotates the handle 64 for the threads 69 and 75 to engage. The locking tab 76 snaps into the locking groove 70, thus securing the handle 64 to the roller 62. Once the strand of hair is rolled on one roller 62, the user presses on the flange 78, causing the locking tab 76 to disengage from the groove 70. The user then rotates the handle 64 until it is released from engagement from the roller 62. The user then engages the handle 64 with other rollers 62 contained in the kit and continues the hair rolling and clipping until the desired quantity of rollers have been secured on the user's head with clips.

The process of rolling the hair and applying heat is similar to the process described above since the roller 62 is also formed from a heat conducting material having defined thermal capacity. Once the rollers 62 are cooled and the hair is dry the user removes the rollers 62 and styles the hair as desired.

It is envisioned that the kit containing the rollers, handles (with one of the locking mechanisms discussed above), clips and instruction sheet can be made available to both professional hairdressers and individual users. The ease of operation makes the assembly of the instant invention applicable to many conditions. It is also envisioned that the types of bristles, their number and size can be determined by the manufacturer.

Many changes and modifications can be made in the design of the present invention without departing from the spirit thereof. I, therefore, pray that my rights to the present invention be limited only by the scope of the appended claims.

I claim:

1. A hair styling assembly comprising:

a hair roller having a proximate end, a distant end and an opening formed in the proximate end, and wherein an internally threaded insert is fitted into the opening, said threaded insert forming a handle engagement member;

a removable handle configured for detachable engagement with the hair roller, said handle comprising a proximate end a distant end and a roller engaging member formed on exterior surface of the proximate end of the handle, said handle engagement member comprises an opening formed in the threaded insert, said opening having a transverse annular groove, and the roller engagement member comprises a locking tab configured to releasably fit into the transverse annular groove; and wherein the roller engaging member is configured to detachably engage with the internally threaded insert of the hair roller.

2. The assembly of claim 1, wherein said handle engagement member comprises internal threads and an annular locking groove formed in the proximate end of the hair roller, said roller engagement member comprises exterior threads formed on the proximate end of the handle, a flexible resilient flange secured on the proximate end of the handle adjacent the external threads, and a locking tab carried by the flange, said tab being configured to fit into the locking groove when the handle is engaged with the hair roller.

3. The assembly of claim 2, wherein said locking tab has a generally wedge-shaped configuration.

4. The assembly of claim 2, wherein said flange is configured to resiliently bend and release the locking tab from the locking groove.

5. The assembly of claim 1, wherein said hair roller is formed from a heat absorbing material.

6. The assembly of claim 1, wherein said hair roller is formed from thermal ceramic.

7. The assembly of claim 1, wherein an exterior of said hair roller is provided with a plurality of bristles.

8. The assembly of claim 1, wherein said hair roller comprises a cylindrical body provided with a plurality of openings configured to facilitate air circulation through the body.

* * * * *